US005392535A

United States Patent [19]

Van Noy et al.

[11] Patent Number: 5,392,535

[45] Date of Patent: Feb. 28, 1995

[54] FASTENING SYSTEM FOR AN ARTICLE OF FOOTWEAR

[75] Inventors: Allen W. Van Noy, Beaverton; Perry W. Auger, Tigard, both of Oreg.

[73] Assignee: Nike, Inc., Beaverton, Oreg.

[21] Appl. No.: 52,033

[22] Filed: Apr. 20, 1993

[51] Int. Cl.[6] ..... A43B 7/14; A43B 11/00

[52] U.S. Cl. ..... 36/88; 36/50.1; 24/68 SK

[58] Field of Search ..... 36/50.1, 88, 89, 114, 36/138, 8.1, 1.5, 2 R, 101, 127, 7.1 R, 7.3, 7.5; 24/68 SK

[56] References Cited

U.S. PATENT DOCUMENTS

| | | | |
|---|---|---|---|
| 145,776 | 12/1873 | Babbitt | 36/50.1 X |
| 177,396 | 5/1876 | Harris | 36/50.1 |
| D. 297,069 | 8/1988 | Le | D2/312 X |
| D. 301,935 | 7/1989 | Jonah | D2/364 |
| D. 321,084 | 10/1991 | Miller et al. | D2/265 |
| D. 328,517 | 8/1992 | Hallenbeck | D2/314 |
| 459,160 | 9/1891 | Troxler, Jr. | 24/712.1 X |
| 737,769 | 10/1901 | Preston | 24/712.1 X |
| 804,397 | 11/1905 | Grushus | 24/54 |
| 2,261,112 | 11/1941 | Deming | 24/169 |
| 2,287,722 | 6/1942 | Beazley | 24/170 |
| 2,513,169 | 6/1950 | Griswold | 24/170 |

(List continued on next page.)

FOREIGN PATENT DOCUMENTS

| | | | |
|---|---|---|---|
| 271814 | 6/1966 | Australia . | |
| 0123050 | 10/1984 | European Pat. Off. . | |
| 616991 | 11/1926 | France . | |
| 999470 | 10/1951 | France . | |
| 2598292 | 11/1987 | France . | |
| 2615074 | 11/1988 | France | 36/114 |
| 83172 | 12/1894 | Germany . | |
| 2900077 | 7/1980 | Germany . | |
| 5084105 | 4/1993 | Japan | 36/50.1 |
| 7506705 | 6/1975 | Netherlands . | |
| 9215214 | 9/1992 | WIPO | 36/114 |

*Primary Examiner*—Paul T. Sewell
*Assistant Examiner*—Beth Anne C. Cicconi
*Attorney, Agent, or Firm*—Banner, Birch, McKie & Beckett

[57] ABSTRACT

A closed loop fastening system for running and other shoes. The fastening system includes a harness, a strap, guides and a tension lock buckle. The harness includes strap portions which can tightly retain a user's foot inside the shoe. The guides are attached to the harness for guiding the strap. One end of the strap is attached to the harness and the other end of the strap is attached to the buckle. An effective length of the strap can be defined such that a shorter effective length yields a tighter harness and a tighter fit, and a longer effective length yields a looser harness and a looser fit. The tension lock buckle used in the closed loop fastening system is adaptable for use with numerous other products having a strap. The tension lock buckle includes a body, a pivotal locking member and a sliding bar. The sliding bar is mounted within the body for longitudinal movement therein. The pivotal locking member is pivotally attached to the body for relative pivotal motion. The pivotal locking member is movable between a locked position and an unlocked position. When the pivotal locking member is in the unlocked position, the tension lock buckle is movable along the strap to adjust the tension thereof. When the pivotal locking member is in the locked position, the strap is clamped against three surfaces of the sliding bar by three complementary surfaces, two located on the pivotal locking member and one located on the body.

28 Claims, 8 Drawing Sheets

U.S. PATENT DOCUMENTS

| | | | |
|---|---|---|---|
| 2,611,940 | 9/1952 | Cairns | 24/712.1 X |
| 2,622,293 | 12/1952 | Wermlinger | 24/170 |
| 2,673,381 | 3/1954 | Dueker | 24/712.1 X |
| 2,751,656 | 6/1956 | Noe | 24/170 |
| 2,836,868 | 6/1958 | Carter | 24/196 X |
| 2,893,090 | 7/1959 | Pagoda | 24/712.1 X |
| 2,998,626 | 9/1961 | Prete, Jr. | 24/170 |
| 3,009,221 | 11/1961 | Firari | 36/50.1 X |
| 3,065,512 | 11/1962 | Pagoda | 24/712.1 X |
| 3,192,588 | 7/1965 | White | 24/170 |
| 3,262,167 | 7/1966 | Martin | 24/712.1 X |
| 3,328,856 | 7/1967 | Jonas | 24/191 |
| 3,376,613 | 4/1968 | Lindblad | 24/308 |
| 3,389,440 | 6/1968 | Jantzen | 24/196 |
| 3,413,691 | 12/1968 | Elsner | 24/134 |
| 3,430,303 | 3/1969 | Perrin et al. | 24/712.3 |
| 3,608,158 | 9/1971 | Bengtsson | 24/134 |
| 3,668,791 | 6/1972 | Salzman et al. | 36/50.5 |
| 3,703,024 | 11/1972 | Johnson | 24/196 X |
| 3,738,027 | 6/1973 | Schoch | 36/50.1 |
| 3,760,466 | 9/1973 | Leblanc | 24/200 |
| 3,808,644 | 5/1974 | Schoch | 36/50.1 |
| 3,834,048 | 9/1974 | Maurer | 36/50.1 |
| 4,005,533 | 2/1977 | Anderson et al. | 36/62 |
| 4,130,949 | 12/1978 | Seidel | 36/50.1 |
| 4,131,976 | 1/1979 | Bengtsson | 24/196 |
| 4,157,622 | 6/1979 | Carlyle | 36/50.1 |
| 4,261,081 | 4/1981 | Lott | 24/117 |
| 4,282,657 | 8/1981 | Antonious | 36/50.1 |
| 4,282,659 | 8/1981 | Bourque et al. | 36/50.1 X |
| 4,296,531 | 10/1981 | Bengtsson | 24/200 |
| 4,360,979 | 11/1982 | Spademan | 36/50.5 X |
| 4,433,456 | 2/1984 | Baggio | 24/68 SK |
| 4,480,395 | 11/1984 | Schoch | 36/50.1 |
| 4,551,932 | 11/1985 | Schoch | 36/50.5 |
| 4,564,983 | 1/1986 | Saito | 24/191 X |
| 4,620,379 | 11/1986 | Sartor | 36/50.5 |
| 4,670,998 | 6/1987 | Pasternak | 36/114 |
| 4,674,155 | 6/1987 | Turtle et al. | 24/170 |
| 4,680,878 | 7/1987 | Pozzobon et al. | 36/117 |
| 4,727,628 | 3/1988 | Rudholm | 24/170 |
| 4,748,726 | 6/1988 | Schoch | 36/50.5 |
| 4,751,772 | 6/1988 | Crowle | 24/170 |
| 4,769,927 | 9/1988 | Liggett et al. | 36/88 |
| 4,811,500 | 3/1989 | Maccano | 36/91 |
| 4,817,303 | 4/1989 | Selbiger | 36/50.1 |
| 4,841,649 | 6/1989 | Baggio et al. | 36/117 |
| 4,843,688 | 7/1989 | Ikeda | 24/170 |
| 4,881,303 | 11/1989 | Martini | 24/170 |
| 4,972,613 | 11/1990 | Loveder | 36/105 |
| 5,109,613 | 5/1992 | Van Dyke | 36/89 |
| 5,117,567 | 6/1992 | Berger | 36/50.1 |

FASTENING SYSTEM FOR AN ARTICLE OF FOOTWEAR

FIELD OF THE INVENTION

This invention relates to a shoe fastening system which is especially for use in a sport, leisure or rehabilitation shoe, where a simple to use, reliable, inexpensive and lightweight fastening system is desirable. More particularly, the invention relates to a closed loop fastening system having a strap, a strap receiving guide and a buckle to adjust the tension of the strap in the midfoot area of the shoe. The buckle also locks the strap in place.

This invention also relates to a buckle for securing a strap. More particularly, the invention also relates to a buckle having a pivotal locking member and a movable bar such that rotating the pivotal locking member to a locked position moves the bar. The strap is then clamped by three surfaces of the bar to provide a more reliable locking buckle.

BACKGROUND OF THE INVENTION

Traditionally and most commonly, fastening systems for most athletic shoes consist of a shoelace and a series of eyelets or holes on opposite sides of the instep of the shoe. To put a laced shoe on, a user typically loosens the lace with both hands a series of times until the upper of the shoe is loose enough to insert their foot. To tighten the shoe, the user pulls on the lace with both hands a series of times and subsequently ties a knot near the ends of the lace securing their foot within the shoe and attempting to retain a tight fit. However, the tightness of the fit does not always remain constant as shoelaces subsequently loosen due to the length of the laces and the pressure of each lace section upon the user's foot eventually evening out.

Shoelaces can also become untied forcing a user to interrupt their actions and retie their shoes to prevent tripping or stumbling over the untied laces. To an athlete, tripping or stumbling may have serious consequences. An untied shoelace to a tennis player may result in the loss of an important point; to a basketball player, the loss of a crucial basket; and to a runner, the loss of a race. More importantly, the athlete may fall causing potentially serious injury to themselves and/or others. Even tied shoelaces can extend below the shoe's outsole causing the user to fall or stumble.

Overtightening of a shoelace can cause high pressure points in the instep area greatly impairing the circulation of blood due to the pressure of the lace exerting a large force across a small area. Additionally, some handicapped persons cannot use shoes with shoelaces because it takes two hands to tie the laces. Further, worn shoelaces are susceptible to breakage during the stress applied thereto in the tightening process, and while they are inexpensive to replace, they may break at inopportune times making the shoes unusable unless a spare shoelace is quickly accessible.

Loop and pile element fastening straps, e.g., VELCRO, have been used on shoes in lieu of or in addition to shoelaces as part of shoe fastening systems. These fastening straps consist of two strips of material which produce a relatively strong holding force when interlocked together. Both U.S. Pat. Des. Nos. 301,935 to Jonah and 321,084 to Miller et al., illustrate shoe fastening systems including loop and pile fastening straps. In Jonah, two parallel straps extend across the instep of the shoe, and in Miller et at., a first strap extends across the instep of the shoe and a second strap extends around the heel of the shoe. However, loop and pile fastening straps have a disadvantage in that they attract dirt and grime onto their holding surfaces causing their strips to lose its holding power. In addition, a loop and pile fastening strap can become caught or snagged by a surface, potentially unfastening and losing its tensioning power.

A fastening system similar to the type used in some ski boots has been converted for use in a running shoe, and is disclosed in U.S. Pat. No. 5,117,567 to Berger. The shoe has an instep shield, a central tightening lock, a steel wire or wire rope, and guide channels. The central tightening lock is designed to be rotatable with the wire or rope attached to a part thereof. Although this fastening system overcomes many of the problems associated with shoelaces, it tends to be costly to manufacture the central tightening lock and labor intensive to assemble its interface with the shoe. Further, the amount of plastic used for the central tightening lock, the instep shield, and the guide channels increases the weight of the shoe, such that it may not be desirable for an avid runner desiring a lightweight running shoe. Also, the tightening lock and other moving parts can be susceptible to contamination by dirt detrimentally affecting the performance of the fastening system.

Another fastening system utilizes an expandable and contractible bladder within the shoe upper and a small pump and relief valve system attached thereto for controlling the pressure inside the bladder. Although this type of fastening system can help provide a fit with a better pressure distribution, it is costly anal is typically used with shoelaces thus containing many of the same disadvantages associated therewith.

Heretofore, many kinds of buckles for fastening or retaining a belt or a strap have been made and used. These buckles typically have a body and a pivotal member attached thereto which is movable between a locked and an unlocked position. In a locked position, a portion of the pivotal member clamps or pinches the strap or belt against a part of the body of the buckle. However, these buckles typically only include one clamping surface which may not be suitable for uses where the reliability of the buckle is an essential quality. As previously discussed, a fastening system on an athletic shoe is one such instance where the loss of shoe tension may be detrimental, possibly causing injury.

U.S. Pat. No. 4,843,688 to Ikeda discloses a belt buckle with a body and a pivotal locking member attached thereto. The body includes a non-sliding bar attached between two opposing sidewalls. The pivotal locking member includes a projection with a non-slip inclined sidewall which interfaces with an apparently smooth sloped surface on the non-sliding bar for frictionally engaging a belt therebetween. The buckle disclosed by Ikeda may be sufficiently reliable for some applications, but in applications where reliable gripping capability is essential, such as use on an athletic shoe, clamping a belt to only one surface of a non-sliding bar, may not be reliable enough.

U.S. Pat. No. 3,328,856 to Jonas discloses a rigid plastic buckle for adjustable shoulder strap assemblies of the kind that are usually employed on women's garments. The body includes a pivotal locking member attached thereto and a non-sliding rectangular bar attached between two opposing sidewalls. The pivotal locking member has a circular concave interior surface or cavity. When the pivotal locking member is in a locked position, the cavity engulfs the non-sliding rectangular bar and frictionally engages the strap only at the four comers of the bar. Hereagain, the buckle disclosed may be sufficiently reliable to hold the forces applied to a strap for some applications, like a shoulder strap of a lightweight women's undergarment, but in applications where reliability is essential, trapping a strap merely at corner points and not between complementary mating surfaces, may not be reliable enough.

SUMMARY

In view of the foregoing, it is a principal object of the present invention to achieve an improvement over the previously known shoe fastening systems and buckles.

More specifically, it is an object of the invention to provide a shoe fastening system which eliminates the aforementioned problems associated with freely suspended shoelaces and loop and pile fastening straps.

Another object of the invention is to provide a shoe fastening system with unsurpassed reliability and one which provides for quick and uncomplicated adjustment and readjustment.

It is yet another object of the invention to provide a long-lasting, lightweight, inexpensive and simple to manufacture shoe fastening system.

Another object of the invention is to provide a shoe fastening system for which a handicapped person having one arm or hand may easily adjust the fit of the shoe.

These and other objects are achieved by the present invention which, according to one aspect, provides a fastening system for adjustably fitting a user's foot within a shoe. The shoe fastening system includes a strap attached to the shoe, a strap receiving guide and a buckle for loosening and tightening the fit of the shoe. The strap has an effective length. A shorter effective length results in a fighter fit than a longer effective length and a longer effective length results in a looser fit than a shorter effective length. The strap receiving guide receives and guides said strap along a path across a portion of the shoe. The buckle includes a locking member which is movable between a first unlocked position and a second locked position. In the first unlocked position, the buckle is movable along the strap to loosen or tighten the fit of the shoe by increasing or decreasing, respectively, the effective length of the strap. In the second locked position, the buckle clamps the strap preventing the motion of the buckle along the strap and keeping the effective length of the strap constant.

Still another object is to provide a buckle which has unsurpassed reliability in preventing strap slip or preventing the inadvertent unfastening thereof.

Another object is to provide a buckle which includes three pairs of substantially complementary mating surfaces which interface in a locked position providing an ultra-dependable locking buckle.

In another aspect, the invention provides a buckle for securing a strap having a main body, a pivotal locking member and a sliding bar. The main body of the buckle includes two side members joined together by a first cross-member. The pivotal locking member is pivotally mounted to the side members of the main body for pivotal movement about a pivot axis spaced from the first cross member. The pivotal locking member is movable between a first unlocked position and a second locked position. In a first unlocked position, the buckle can be moved with respect to the strap. In the second locked position, the buckle is prevented from being moved with respect to the strap. The sliding bar is slidably mounted with respect to the side members of the main body for axial movement therealong. The strap is clamped against the sliding bar when the pivotal locking member is in the second locked position.

The invention provides in an additional aspect, a buckle for securing a strap having a main body with two side members and a first cross-member, a pivotal locking member and a bar. The pivotal locking member is pivotally mounted with respect to the side members of said body for pivotal movement about an axis spaced from said first cross-member. The pivotal locking member is movable between a first unlocked position whereby the buckle is movable with respect to the strap and a second locked position whereby the strap is clamped by said buckle. The bar is mounted to both the side members of the body and includes a top surface, a first side surface facing the first cross-member, and a second side surface facing in a direction opposite of said first side surface. The buckle also includes a first complementary surface and a second complementary surface. The first complementary surface substantially complementarily mates with one of the bar surfaces, and the second complementary surface substantially complementarily mates with another of the bar surfaces. The strap is clamped between the complementary mating surfaces when the pivotal locking member is in the second locked position.

These and other objects and features of the invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENT

Figure 1:
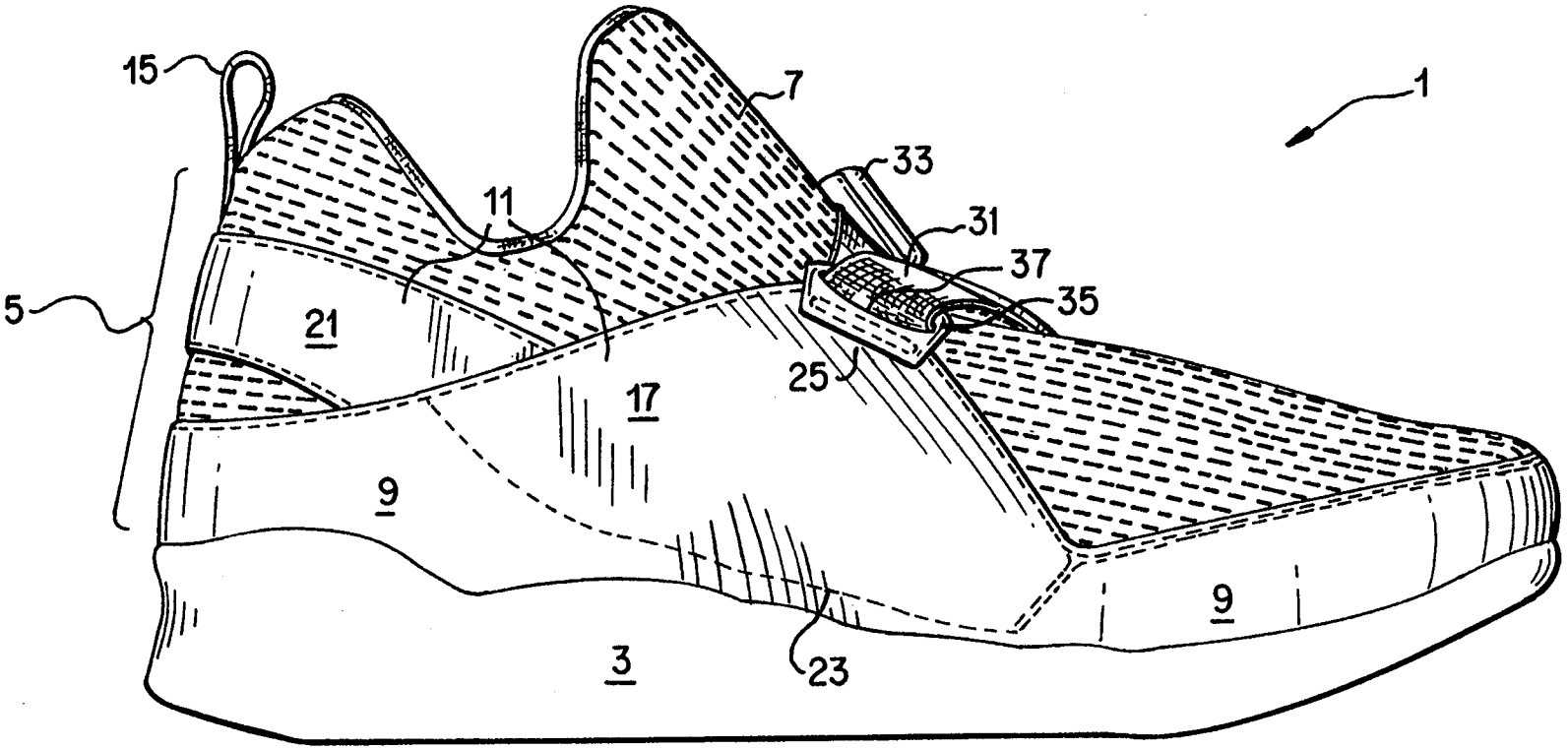
FIG. 1 is a medial side view of a running shoe having the closed loop fastening system of the present invention.

As can be seen from FIGS. 1–5, a running shoe is identified generally by reference numeral 1. Shoe 1 consists primarily of a shoe midsole 3, an outsole, not shown, for the interface with floor and ground surfaces, and a shoe upper 5 encasing and providing fore, aft and lateral support for a user's foot within shoe 1.

Shoe upper 5 primarily includes an innerboot 7, a trim 9 and a harness 11. Innerboot 7 is sewn or affixed in another manner to a portion of shoe 1 and surrounds, covers and hugs a user's foot within shoe 1 similar to an elastic-banded sock. Trim 9 is attached to midsole 3 and provides support to the user's foot on the lower part of the shoe upper 5. While trim 9 is preferably made from a leather, synthetic leather or other material with similar characteristics, innerboot 7 is preferably made from lightweight, breathable and expandable material permitting the foot to breathe while creating the aforementioned hugging effect. Although not shown, it is preferable to have innerboot 7 made of two different types of material. A lower portion of innerboot 7 is preferably made from a breathable mesh material and an upper portion of innerboot 7, which would cover the middle and upper portions of the foot, is preferably made of material having high elastic properties, e.g., LYCRA or NEOPRENE. This two material arrangement maximizes the breathing objective permitting the foot to breathe easier on the lower part of the foot where users' typically sweat, and maximizes the hugging objective by retaining the foot with a stronger holding force on the middle and upper portions of the foot, where a stronger holding force is preferable. Further, the high elasticity of the LYCRA or NEOPRENE makes it easier for a user to insert their foot into shoe 1.

The upper portion of innerboot 7 includes a foot opening 13 enabling a user to insert their foot into shoe 1. To put on the shoe, a user loosens the harness 11 and inserts their foot into foot opening 13 with the elastic properties of innerboot 7 permitting the insertion of the entire foot into shoe upper 5. To aid with the insertion, shoe upper 5 preferably includes a pull loop back tab 15 for enlarging foot opening 13. A user accomplishes this feat by pulling backwards on pull loop back tab 15 while inserting their foot, thus stretching the rear of foot opening 13 backwards.

Figure 2:
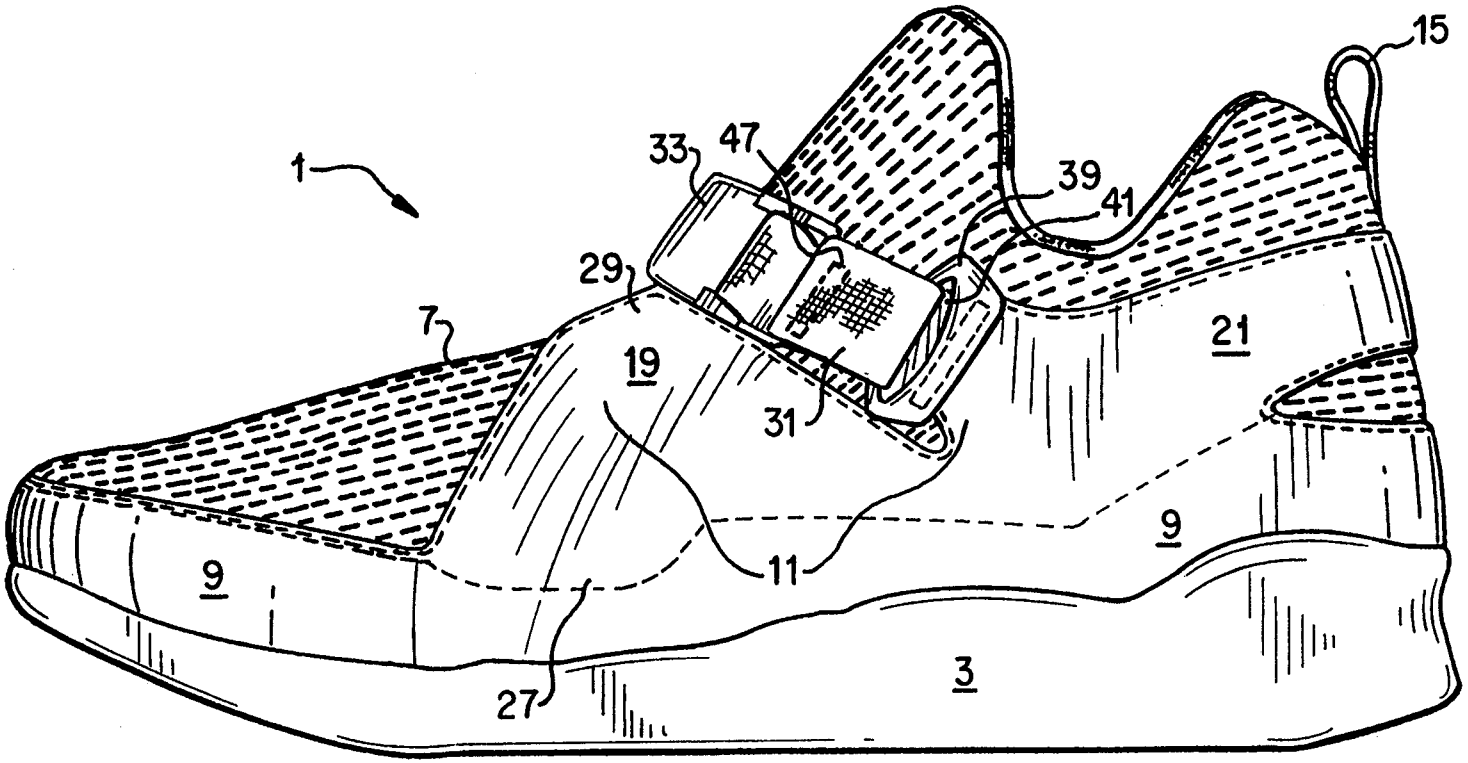
FIG. 2 is a lateral side view of the running shoe of FIG. 1.
Figure 4:
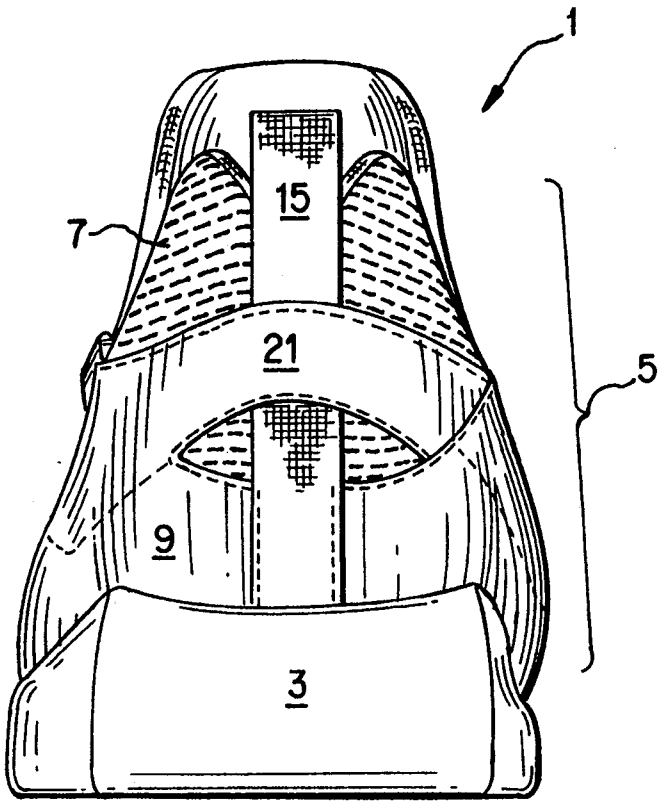
FIG. 4 is a rear view of the running shoe of FIG. 1.
Figure 3:
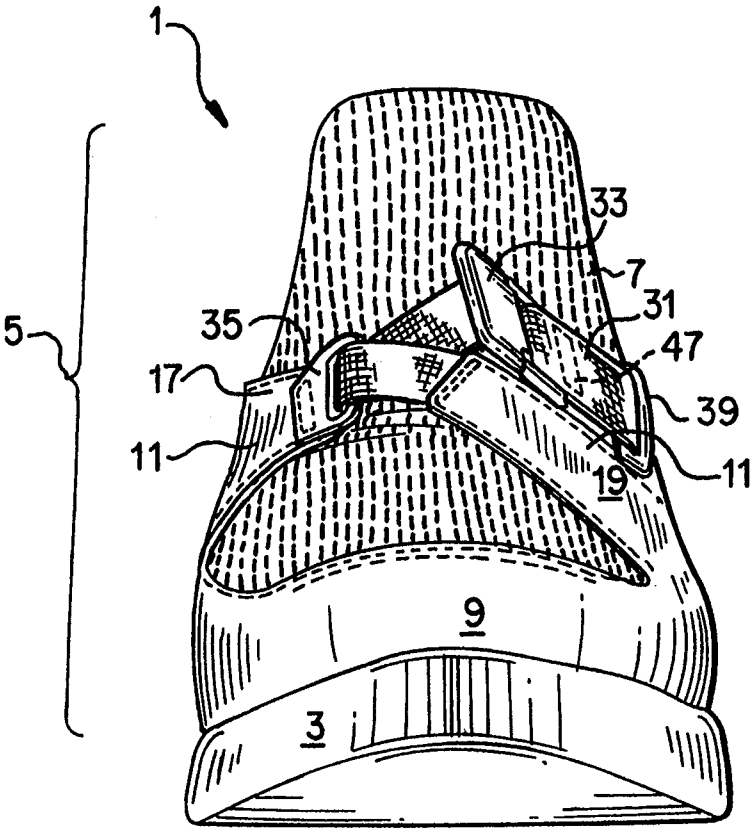
FIG. 3 is a front view of the running shoe of FIG. 1.

Harness 11 which can be loosened and tightened is preferably attached to shoe midsole 3 or trim 9, as shown in FIGS. 1 and 2. Harness 11 securely holds the user's foot within shoe 1 when tightened and includes a medial strap portion 17, a lateral strap portion 19 and a heel strap portion 21. Medial strap portion 17 is attached at one end 23 to trim 9 at the inner lower part of shoe upper 5 and extends to the inner part of the shoe instep, terminating at a free end 25. Lateral strap portion 19 is attached at one end 27 to trim 9 at the outer lower part of shoe upper 5 and extends to the outer part of the shoe instep, terminating at free end 29. Heel strap portion 21 extends from the rear portion of medial strap portion 17 to the rear portion of lateral strap portion 19, circumventing the back of the heel of the user's foot.

When harness 11 is tightened around a foot, heel strap portion 21 supports the back and the heel of the foot preventing rearward movement of the foot with respect to shoe 1, while medial strap portion 17 and lateral strap portion 19 support the sides and the instep of the foot preventing sideward movement of the foot with respect to shoe 1. Trim 9 at the front of the shoe upper prevents forward movement of the foot with respect to shoe 1. Strap portions 17, 19, 21 are preferably made from leather, synthetic leather or another material having similar properties.

The tension of harness 11 can be adjusted by a tension adjustment system which includes a flaccid adjustable strap 31, a tension lock buckle 33 and two strap receiving guides shown as a medial eye bracket 35 having a hole 37 and a lateral eye bracket 39 having a hole 41. Although strap 31 may be of any well known strapping material, it is preferably made of a woven nylon material because woven nylon straps tend to be thinner, stronger and more tear resistant than most strapping material. Tension lock buckle 33 is preferably lightweight and made from plastic. A more detailed description of the materials and manufacture of tension lock buckle 33 appears hereinafter.

Medial eye bracket 35 and lateral eye bracket 39 receives and guides strap 31 along a path across a portion of shoe 1. Medial eye bracket 35 is sewn or attached in any effective manner to free end 25 of medial strap portion 17 while lateral eye bracket 39 is similarly attached to heel strap portion 21. Medial and lateral eye brackets 35, 39 are preferably made from any lightweight plastic, e.g., nylon 66, and are injection molded, although other types of plastic and methods of manufacturing may be used. It is not required that eye brackets 35, 39 be plastic, as metal and wooden brackets could also be used, however plastic is the material of choice because it also provides a low coefficient of friction between the eye brackets 35, 39 and strap 31.

Figure 5:
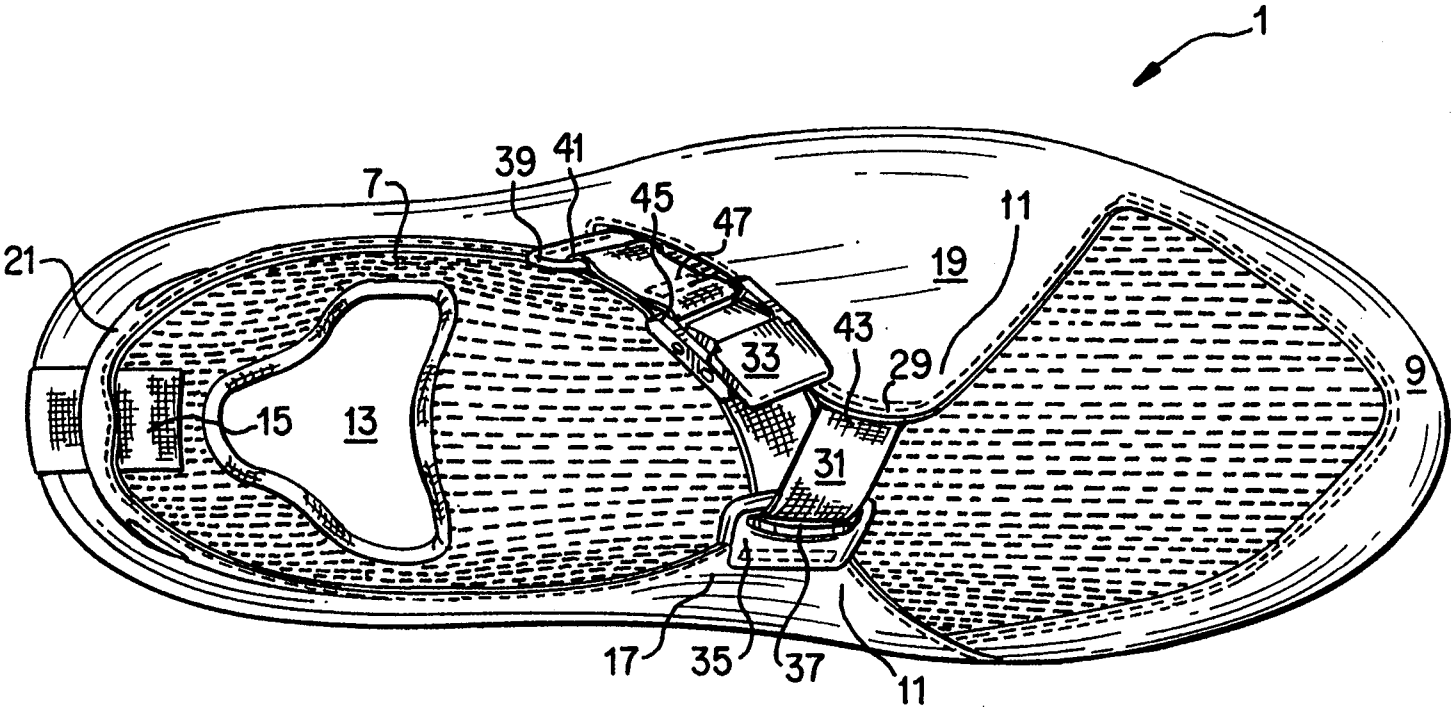
FIG. 5 is a top view of the running shoe of FIG. 1.

As best shown in FIG. 5, one end 43 of strap 31 is sewn or affixed in a similar manner to free end 29 of lateral strap 19. Strap 31 is routed through hole 37 in medial eye bracket 35 extending across the user's instep a first time. From this point, strap 31 passes through tension lock buckle 33 and hole 41 in lateral eye bracket 39, extending across the user's instep a second time. From lateral eye bracket 39, strap 31 extends around a bar on tension lock buckle 33 and the other end 45 of strap 31 is sewn to strap 31 at 47, attaching tension lock buckle 33 to strap 31. However, other methods of attaching ends 43, 45 of strap 31 to their respective attachment points of free end 29 and strap 31 may be used to perform the same function.

Tension lock buckle 33, which is fully described in detail hereinafter, is movable along strap 31 and has a locking member which is movable between a first unlocked position and a second locked position. In the first unlocked position, tension lock buckle 33 can freely move along strap 31, while in the second locked position, tension lock buckle 33 clamps strap 31 therebetween preventing any movement of tension lock buckle 33 with respect to strap 31.

When tension lock buckle 33 is moved adjacent lateral eye bracket 39, it is in a position which will be referred to as a "loosened position". When tension lock buckle 33 is moved adjacent medial eye bracket 35, it is in a position which will be referred to as a "tightened position". In a tightened position, the distance between: (i) strap end 43 and medial eye bracket 35, (ii) medial eye bracket 35 and lateral eye bracket 39, and (iii) the strap 31 distance between strap end 43 and lateral eye bracket 39, are shorter than when in a loosened position. Each of these distances define an effective length such that a shorter effective length results in a tighter harness 11 and fit, and a longer effective length results in a looser harness 11 and fit. All of the effective lengths are made shorter when tightened because the length of the strap 31 from lateral eye bracket 39 to buckle 33 increases.

In operation, a user moves tension lock buckle 33 and strap 31 to a loosened position, and inserts their foot into innerboot 7 through foot opening 13, optionally utilizing pull loop back tab 15. Once their foot is inside innerboot 7, the user tightens harness 11 by moving tension lock buckle 33 along strap 31 towards medial eye bracket 35. Once the desired harness 11 tension is reached, the user moves the locking member to the second locked position preventing the loosening of harness 11. At this point, the user's foot is securely restrained within shoe 1 and the user need not worry about tripping over laces, breaking laces, high pressure points exerted by laces, or surrounding dirt and grime which can adversely affect loop and pile fastening straps.

To remove their foot from shoe 1, the user must move the locking member to the first unlocked position and move tension lock buckle 33 towards lateral eye bracket 39, loosening harness 11. The user may now easily remove their foot from innerboot 7 and shoe 1, leaving the locking member unlocked and tension lock buckle 33 adjacent lateral eye bracket 39.

The disclosed closed loop fastening system has many advantages. First, because there are no laces to become untied, it is more reliable than most present shoe fastening systems. Secondly, only a single hand is required to tighten, loosen, lock and unlock the system, a convenience for most users and a necessity for some handicapped users. Additionally, all of its elements are lightweight and simple to manufacture because it is made up of essentially one nylon strap, two nylon guides and a plastic tension lock.

Numerous modifications can be made to the above described and shown embodiments without departing from the scope of the invention. For example, it is not necessary to have an innerboot 7, as the present fastening system could effectively be used on a shoe having a traditional separated or split tongue design. In addition, although the preferred buckle 33 used in the present fastening system is the tension lock buckle 33, as shown in FIGS. 6–10 and described hereinafter, other types of buckles may be used without departing from the scope of the invention. Further, other harness designs could be used to perform the same function as the disclosed harness 11, so long as an effective length having the described relationship can be defined. Additionally, this fastening system can be used on other sport, leisure, rehabilitation or other type of shoes, and is not limited to the shown and described running shoe embodiment.

Figure 6:
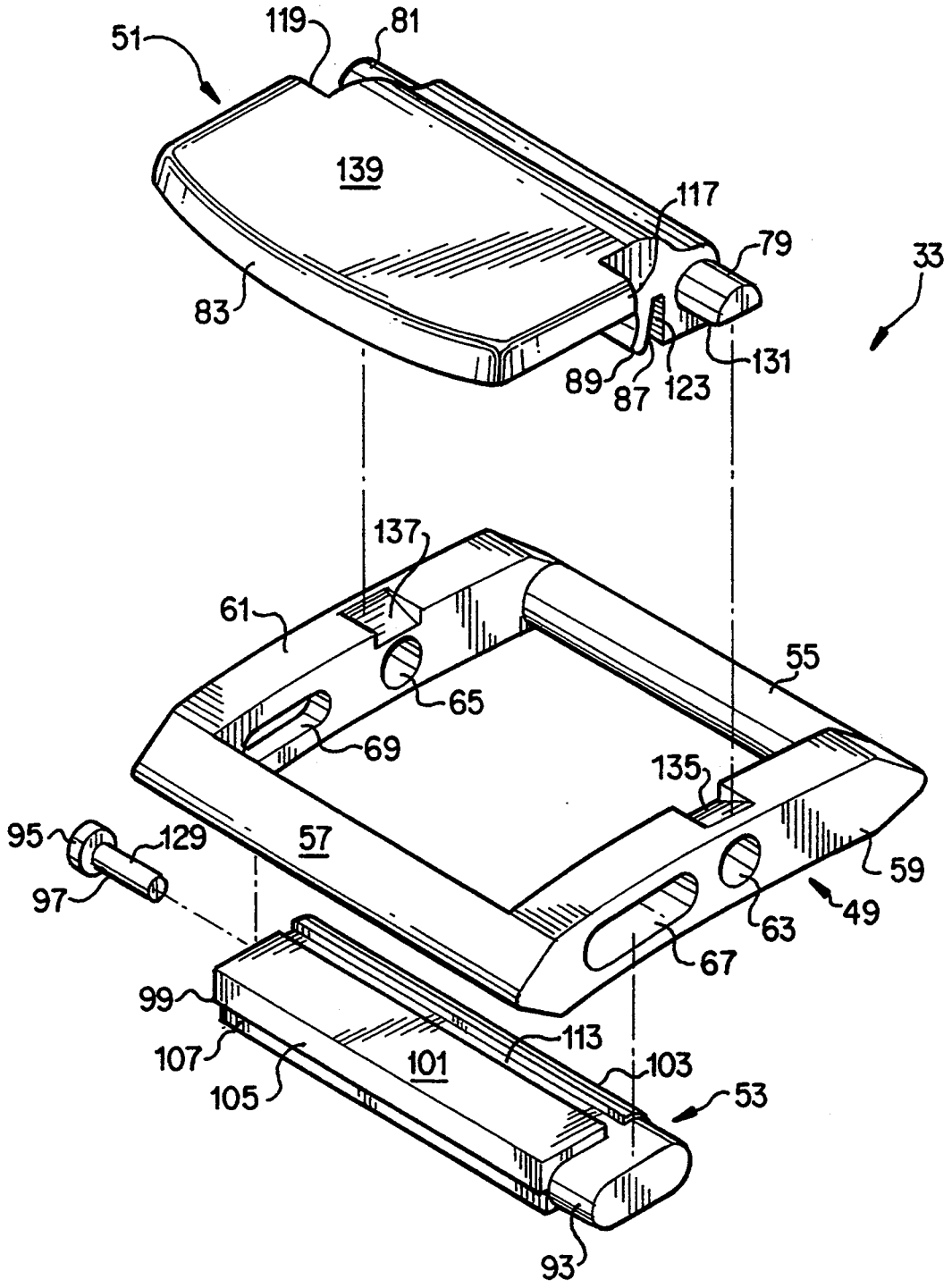
FIG. 6 is an exploded view of the tension lock buckle of the present invention.

Tension lock buckle 33 is shown in detail in FIGS. 6–10. As best illustrated in FIG. 6, tension lock buckle 33 comprises a body 49, a pivotal locking member 51, and a sliding bar 53. Pivotal locking member 51 is pivotally mounted to body 49, while sliding bar 53 is slidably mounted to body 49 for longitudinal movement therein.

Body 49 is an integrally formed piece having a rear cross-member 55, a front cross-member 57, a first side member 59 and a second side member 61. Each side member 59, 61 is perforated with a hole 63, 65 and a longitudinal slot 67, 69. Front cross-member 57 has a rear surface 71 with upper and lower faces 73, 75 offset by an upwardly facing ledge 77 for clamping strap 31 in a manner described hereinafter.

Figure 7:
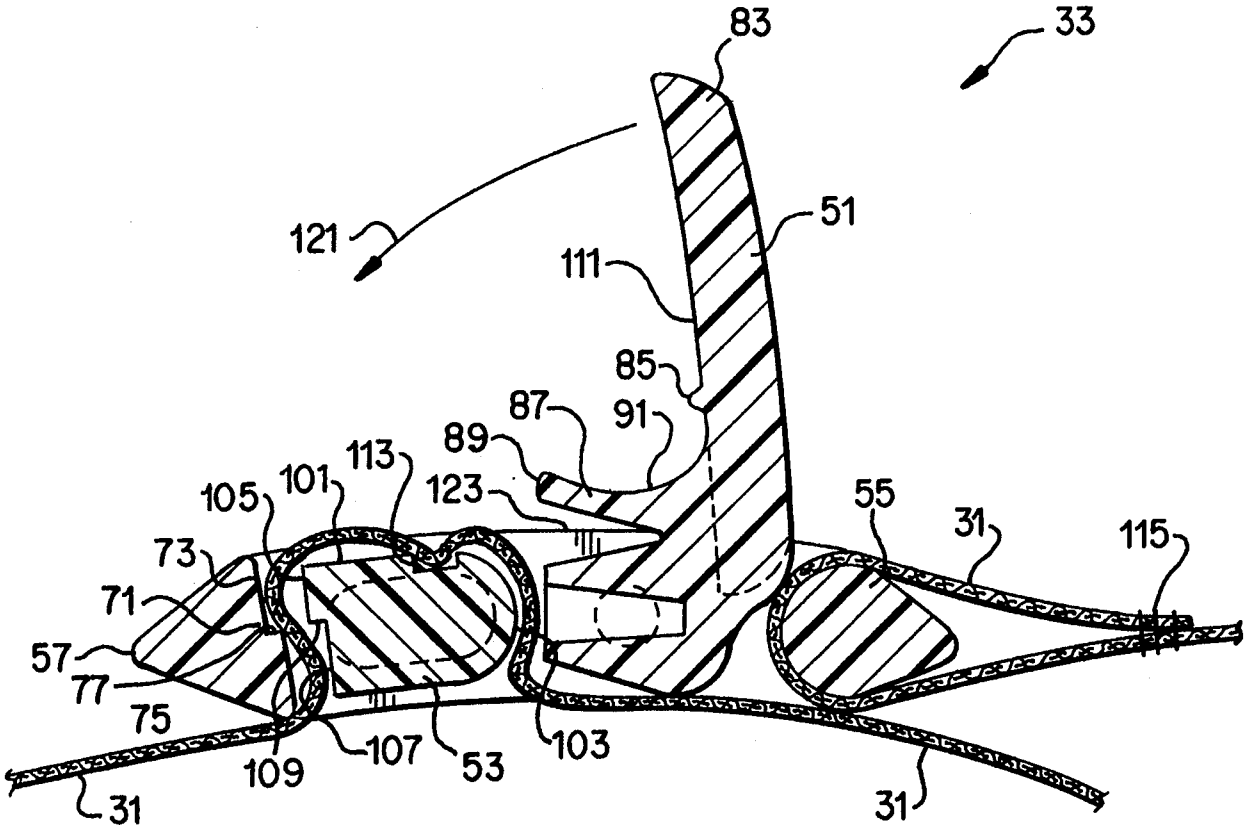
FIG. 7 is a cross sectional view of the tension lock buckle of FIG. 6 shown in an unlocked or adjustable position.
Figure 8:
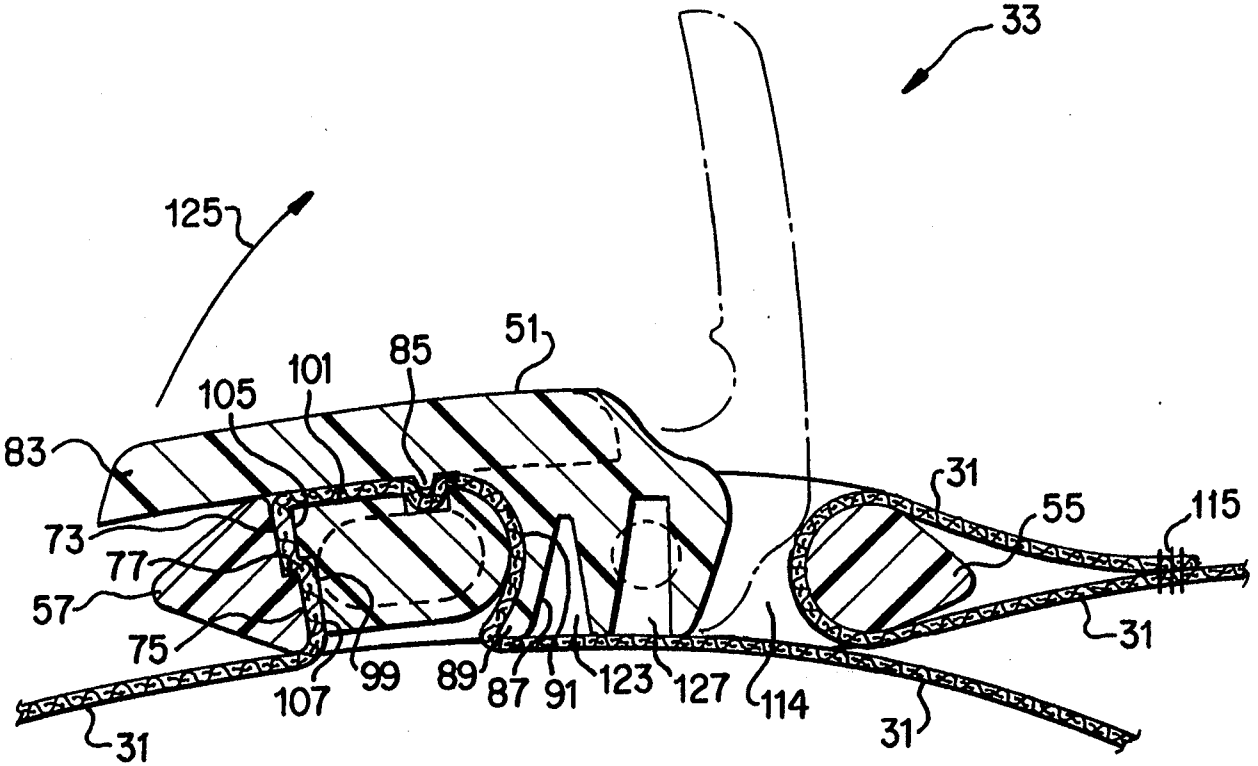
FIG. 8 is a cross sectional view of the tension lock buckle of FIG. 6 shown in a locked position.
Figure 9:
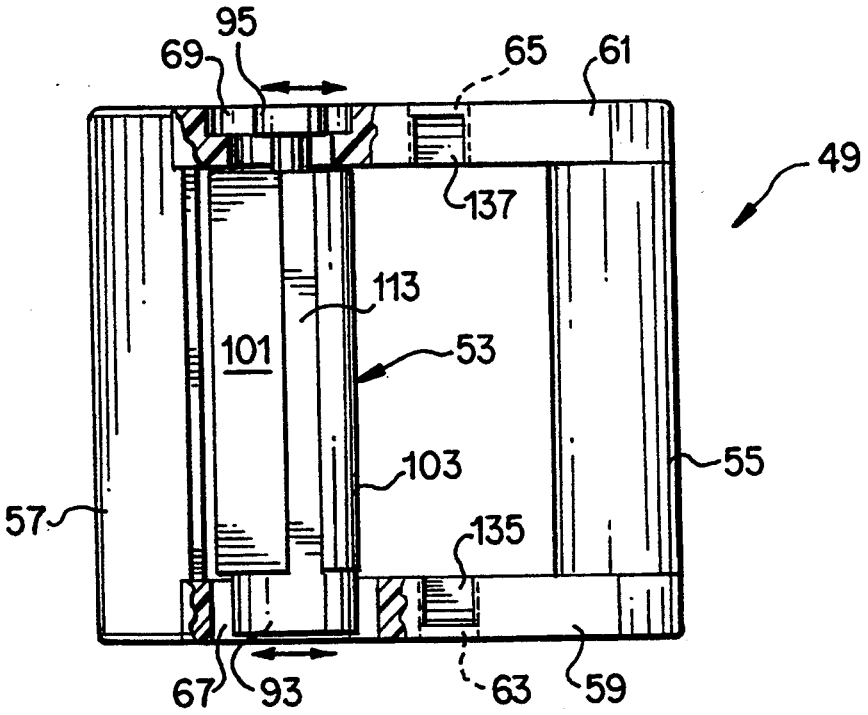
FIG. 9 is a top view of the body and the sliding bar of the tension lock buckle of FIG. 6.
Figure 10:
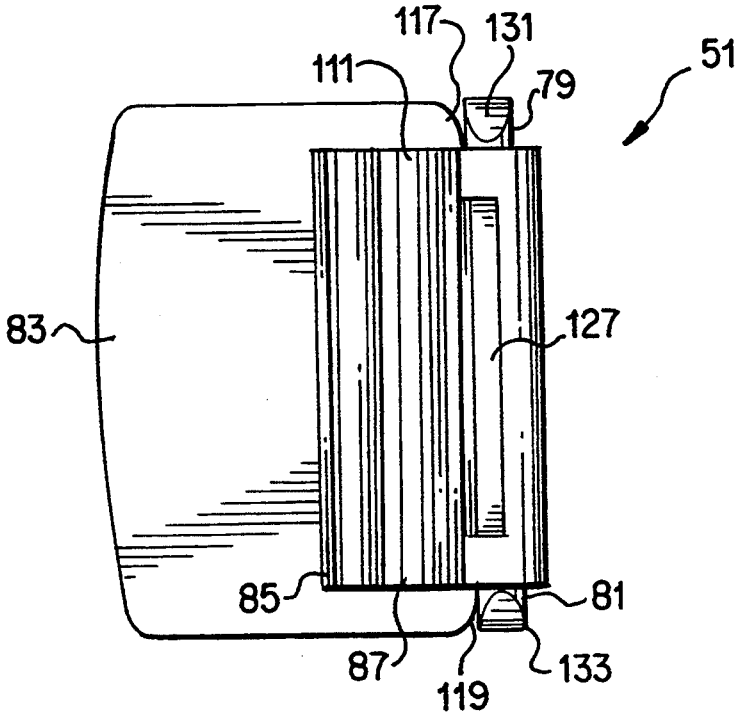
FIG. 10 is a bottom view of the pivotal locking member of the tension lock buckle of FIG. 6.

Pivotal locking member 51 includes two laterally extending shaft portions or members 79, 81 on opposite sides of pivotal locking member 51, which reside within holes 63, 65 of side members 59, 61 permitting pivotal motion of pivotal locking member 51 with respect to body 49, such that it is movable between a first unlocked or adjustable position, as shown in FIG. 7, and a second locked position, as shown in FIG. 8. Pivotal locking member 51 also includes a finger gripping portion 83 assisting a user in pivoting pivotal locking member 51 and moving buckle 33 with respect to strap 31, a protrusion or pinch ridge 85 and a bar pushing member 87. Bar pushing member 87 includes a bottom portion 89 for pushing sliding bar 53, and an inner arcuate surface 91 for clamping strap 31, as later described.

Sliding bar 53 includes an integrally formed first oval shaped laterally extending sliding member 93 and an attached second circular laterally extending sliding member 95 which is preferably part of a stainless steel pin 97. First oval shaped laterally extending sliding member 93 and second circular laterally extending sliding member 95 reside within first and second longitudinal slots 67, 69, respectively, permitting sliding bar 53 to longitudinally slide therein. Sliding bar 53 is movable between a rearward position when pivotal locking member 51 is in an unlocked or adjustable position, as shown in FIG. 7, and a forward position when pivotal locking member 51 is in a locked position, as shown in FIG. 8.

Sliding bar 53 also includes a front surface 99, a top surface 101 and a rear surface 103. Front surface 99 is substantially complementary to rear surface 71 of front cross member 57, having upper and lower faces 105, 107 offset by a downwardly facing ledge 109 for clamping strap 31. Top surface 101 is substantially complementary to a portion of the underside 111 of pivotal locking member 51, having a groove 113 formed therein interfacing with pinch ridge 85 for clamping strap 31. Rear surface 103 is substantially complementary to inner arcuate surface 91 of bar pushing member 87, which is also for the purpose of clamping strap 31.

Tension lock buckle 33 will typically be used with a single strap 31. In a preferred embodiment, strap 31 is fixed at a first end to a forward point, not shown. As best shown in FIGS. 7 and 8, strap 31 is routed through tension lock buckle 33 around sliding bar 53 extending (i) upwardly between front cross member 57 and front surface 99 of sliding bar 53, (ii) over top surface 101 of sliding bar 53, and (iii) downwardly between pivotal locking member 51 and rear arcuate surface 103 of sliding bar 53. Strap 31 then extends rearwardly around a guide, not shown, and returns back to tension lock buckle 33. Upon return, strap 31 enters an aperture 114 between the side members 59, 61, rear cross member 55, and pivotal locking member 51, encircling rear cross member 55. Second end of strap 31 is attached to itself at 115 by any well known attachment method, e.g., sewing. This type of arrangement is referred to as a closed loop fastening system because it permits a single strap to control an effective distance between two points by changing the size of a loop formed from the second end of the strap 31 at 115, extending around a guide not shown, and ending at tension lock buckle 33. A smaller loop size correlates to a larger effective distance and a looser strap while a larger loop size correlates to a smaller effective distance and a tighter strap. A preferred closed loop fastening arrangement is disclosed in conjunction with the shoe fastening system as shown in FIGS. 1–5.

The operation of tension lock buckle 33 will now be described. To adjust the tension of the strap 31, pivotal locking member 51 must be in the unlocked or adjustable position, as shown in FIG. 7. In the unlocked position, the adjustment of the tension may be made by holding gripping portion 83 of pivotal locking member 51, e.g., with the thumb and index finger, and sliding tension lock buckle 33 along strap 31. Sliding tension lock buckle 33 forwardly, i.e., to left in FIG. 7, increases the tension on strap 31, while sliding tension lock buckle 33 rearwardly, i.e., to right in FIG. 7, decreases the tension on strap 31. Pivotal locking member 51 includes stops 117, 119 which abut side members 59, 61 when pivotal locking member 51 is fully open, aiding in the adjustment process by converting the force applied between pivotal locking member 51 and body 49 to a force applied to body 49 to move tension lock buckle 33 along strap 31. Once the desired tension is reached, pivotal locking member 51 is pivoted downward in the direction of arrow 121 rotating pivotal locking member 51 to the locked position, as shown in FIG. 8, preventing the movement of tension lock buckle 33 with respect to strap 31.

During this rotation, bottom portion 89 of bar pushing member 87 displaces or pushes sliding bar 53 forwards towards front cross member 57. This pushing is accomplished by bottom portion 89 of bar pushing member 87 pushing against the arcuate shape of the rear surface 103 of sliding bar 53. During this process, bar pushing member 87 flexes slightly rearwardly to fit around rear surface 103 of sliding bar 53, allowing pivotal locking member 51 to move into its locked position. The slight flexing of bar pushing member 87 is due to its minimal thickness, its plastic material and a gap 123 allowing bar pushing member 87 the necessary space to flex backwards.

Upon pivotal locking member 51 moving to the locked position and sliding bar 53 moving to its forwardmost position, as shown in FIG. 8, an unparalleled locking arrangement is achieved. The locking arrangement includes a friction lock created by three substantially complementary engaging surfaces providing a friction lock which extends a total of substantially 270° around sliding bar 53.

Front, top and rear surfaces 99, 101, 103 of sliding bar 53 each provide a surface for the friction lock. Front surface 99 of sliding bar 53 is pressed against rear surface 71 of front cross member 57 clamping strap 31 therebetween. A portion of underside 111 of pivotal locking member 51 is pressed against top surface 101 of sliding bar 53 clamping strap 31 therebetween. Inner arcuate surface 91 of bar pushing member 87 of pivotal locking member 51 is pressed against arcuate rear surface 103 of sliding bar 53 clamping strap 31 therebetween. This trisurface locking arrangement provides additional reliability that strap 31 will not loosen.

In addition to the 270° tri-surface friction lock, the locking arrangement includes two pinching points which significantly enhance the strength of the locking arrangement. The first pinching provision is provided by opposing oriented ledges 77, 109. Upon front surface 99 of sliding bar 53 pressing against rear surface 71 of front cross member 57 to clamp strap 31 therebetween, upwardly facing ledge 77 and downwardly facing ledge 109 act as gripping or retaining members by matingly engaging to pinch or clamp strap 31 therebetween. The second pinching provision is provided by pinch ridge 85 and groove 113 interfacing and acting as gripping members. Upon a portion of underside 111 of pivotal locking member 51 being pressed against top surface 101 of sliding bar 53 damping strap 31 therebetween, pinch ridge 85 pinches or clamps strap 31 inside groove 113 creating a tongue-and-groove type clamping lock upon strap 31. Thus the tri-surface, dual-pinching locking arrangement creates an ultrareliable locking arrangement which cannot loosen.

To unlock pivotal locking member 51, gripping portion 83 is pivoted in the direction of arrow 125. Since inner arcuate surface 91 of bar pushing member 87 is curved around rear arcuate surface 103 of sliding bar 53 to prevent inadvertent unlocking, the force required to unlock pivotal locking member 51 must be sufficient to flex bar pushing member 87 rearwardly. Once the required force is applied, pivotal locking member 51 moves to the unlocked or adjustable position, as shown in FIG. 7, and the tension of strap 31 can be adjusted as previously described.

As previously described, the incorporation of a sliding bar 53, in the preferred embodiment, permits the clamping of strap 31 by an additional set of complementary surfaces 99, 71. This extra set of complementary surfaces 99, 71 allows buckle 33 to clamp strap 31 to withstand an exceptionally strong pulling force on strap 31 without slippage. A test was performed to compare the holding force of tension lock buckle 33 when sliding bar 53 is prevented from sliding forward into front cross member 57 and when sliding bar 53 is permitted to slide into front cross member 57. In a first buckle, stopping members were placed within the front portion of longitudinal slots 67, 69. When pivotal locking member 51 was moved to a locked position, sliding bar 53 was prevented from sliding into front cross member 57 by the stopping members. In the arrangement, buckle 33 prevented the slippage of strap 31 until a pulling force of 3 kilograms was applied to the strap. In a second buckle, no stopping members were used. When pivotal locking member 51 was moved to a locked position, sliding bar 53 was permitted to slide into front cross member 57. In this arrangement, buckle 33 prevented the slippage of strap 31 until a pulling force of 25 kilograms was applied to the strap. Thus, the results of the test showed that the use of sliding bar 53, in the preferred embodiment, had a significant increase in the gripping capability over the same or similar buckle design, having a fixed bar.

To manufacture tension lock buckle 33, body 49, pivotal locking member 51 and sliding bar 53 without pin 97, are individually molded by any suitable method from a thermo-setting or thermoplastic. The specific material used is preferably a polyamide, e.g., nylon 66, and such a thermoplastic material would preferably be injection molded. Pivotal locking member 51 includes a recess 127 molded therein to prevent stresses which occur during shrinkage inherent in the molding process by evening out the wall thickness. In addition, the inclusion of recess 127 decreases the overall weight of tension lock buckle 33.

To assemble tension lock buckle 33, sliding bar 53 is placed without pin 97 inside body 49 by inserting second laterally extending sliding member 93 into longitudinal slot 67 at an angle. The oval shape of second laterally extending sliding member 93 permits the easy insertion of sliding bar 53 into body 49. Sliding bar 53 is then straightened and aligned against front cross member 57, and an insertion shaft 129 of pin 97 is force-fitted through longitudinal slot 69 in sliding bar 53, not shown. Insertion shaft 129 of pin 97 preferably includes two barbs, not shown, which prevent pin 97 from backing out of the hole in sliding bar 53.

Once sliding bar 53 and body 49 are attached, pivotal locking member 51 may then be attached to body 49. Laterally extending shaft portions 79, 81 of pivotal locking member 51 include tapered sections 131,133, and side members 59, 61 of body 49 include indents 135, 137 for ease of assembly. To attach pivotal looking member 51 to body 49, one must merely align tapered section 131 with indent 135, and tapered section 133 with indent 137, and apply a downward force. The downward force temporarily deflects pivotal locking member 51 until laterally extending shaft portions 79, 81 snap into holes 63, 65. At this point tension lock buckle 33 is fully assembled.

Another feature provided by tension lock buckle 33 is that top surface 139 of pivotal locking member 51 is disposed for convenient viewing by observers. Thus, top surface 139 may include an ornamental design, a trademark or any design of a manufacture's choice, which could make the product more appealing to consumers.

Although the preferred usage embodiment of tension lock buckle 33 is with a shoe, it should be recognized that tension lock buckle 33 could be used on numerous other products providing the same ease of use and reliable locking arrangement. For example, tension lock buckle 33 could easily be used with a backpack, an accessory bag, a belt or with any other product utilizing a strap.

While particular embodiments of the tension lock buckle have been shown and described, it is recognized that various modifications thereof will occur to those skilled in the art. Therefore, the scope of the hereindescribed invention shall be limited solely by the claims appended hereto.

What is claimed is:

1. A fastening system for adjustably fitting a user's foot within an article of footwear, said fastening system comprising:

a strap attached to the article of footwear and having an effective length whereby a shorter effective length will result in a tighter fit than a longer effective length and a longer effective length will result in a looser fit than a shorter effective length, said strap having first and second opposite ends;

a strap receiving guide for receiving and guiding said strap along a path across a portion of the article of footwear; and a buckle for loosening and tightening the fit of the article of footwear, said buckle having a locking member movable between a first unlocked position whereby said buckle is movable along said strap to loosen or tighten the fit of the article of footwear by increasing or decreasing, respectively, the effective length of said strap, and a second locked position whereby said strap is clamped by said buckle to keep the effective length of the strap constant;

said first end of said strap being affixed to the article of footwear at a position spaced from said buckle and said second end of said strap being attached to said buckle.

2. The fastening system as claimed in claim 1, further comprising two strap receiving guides, wherein each said strap receiving guide is an eye bracket, and said buckle being movable along said strap between the two eye brackets.

3. The fastening system as claimed in claim 1, wherein said locking member is pivotally movable between said first unlocked and second locked positions.

4. The fastening system as claimed in claim 3, further comprising a gripping portion on said locking member, and wherein said gripping portion provides a surface which can be grasped to move the buckle along the strap or to pivotally move the locking member between its first and second positions.

5. The fastening system as claimed in claim 1, further comprising a harness, and wherein decreasing the effective length of the strap tightens the harness and increasing the effective length of the strap loosens the harness.

6. The fastening system as claimed in claim 5, wherein said first end of said strap is permanently affixed to said harness.

7. The fastening system as claimed in claim 6, wherein said first end of said strap is sewn to said harness.

8. The fastening system as claimed in claim 1, said buckle further having a body including two side members and a first cross-member for joining together said side members and a sliding bar slidably mounted with respect to said side members of the body for axial movement therealong, said movable locking member being pivotally mounted to said side members of said body for pivotal movement about a pivot axis spaced from said first cross member, wherein the strap is clamped against said sliding bar when said pivotal locking member is in said second locked position.

9. The fastening system as claimed in claim 8, said buckle further having a pushing member provided on said pivotal locking member which displaces said sliding bar towards said first cross-member to clamp the strap between said sliding bar and said first cross-member.

10. The fastening system as claimed in claim 8, said buckle further having a first gripping member on said sliding bar and a second gripping member on said pivotal locking member, and wherein said first and second gripping members pinch the strap therebetween when said pivotal locking member is in said second locked position.

11. The fastening system as claimed in claim 8, said buckle further having a first retaining member on said sliding bar and a second retaining member on said first cross-member, said first and second retaining members are oppositely oriented ledges which matingly engage, and wherein said oppositely oriented ledges pinch the strap therebetween when said pivotal locking member is in said second locked position.

12. The fastening system as claimed in claim 8, said buckle further having a slot in each said side member between said first cross-member and said pivot axis, and said sliding bar including sliding members at opposite ends of said sliding bar, wherein said sliding members of said sliding bar slide within said slots.

13. The fastening system as claimed in claim 8, wherein said strap is routed through said buckle such that said buckle is attached to the strap and no other part of the article of footwear, and said buckle further having a second cross-member joining said side members, wherein said second cross-member, said pivotal locking member, and said side members define an aperture therebetween for the strap to pass therethrough.

14. The fastening system as claimed in claim 1, said buckle further having a body including two side members and a first cross-member, a bar mounted to both said side members of the body, a first complementary surface, and a second complementary surface, said movable locking member is pivotally mounted with respect to said side members of said body for pivotal movement about an axis spaced from said first cross-member, said bar including a top surface, a first side surface facing said first cross-member, and a second side surface facing in a direction opposite of said first side surface, said first complementary surface substantially complementarily complementarily mating with one of said bar surfaces and said second complementary surface substantially complementarily mating with another of said bar surfaces, and wherein the strap is clamped between said first complementarily mating surface and said one of the bar surfaces, and said second complementarily mating surface and said another of the bar surfaces, when said pivotal locking member is in said second locked position.

15. The fastening system as claimed in claim 14, said buckle further having a third complementary surface for substantially complementarily mating with the remaining one of said bar surfaces, and wherein the strap is clamped between said third complementarily mating surface and said remaining one of said bar surfaces when said pivotal locking member is in said second locked position.

16. The fastening system as claimed in claim 14, wherein a first surface of said bar includes a first gripping member and a second surface of said bar includes a second gripping member, said pivotal locking member including a first protrusion to pinch the strap into said first gripping member and said first cross-member including a ledge to pinch the strap against said second gripping member, when said pivotal locking member is in said second locked position.

17. The fastening system as claimed in claim 14, wherein said bar is slidably mounted for axial movement within said side members and said strap being routed through said buckle such that said buckle is attached to the strap and no other part of the article of footwear.

18. The fastening system as claimed in claim 1, wherein said article of footwear includes a lateral side, a medial side, and an instep portion, said fastening system further comprising a first strap receiving guide on one of said lateral and medial sides of the article of footwear and a second strap receiving guide on the other of said lateral and medial sides of the article of footwear, said first end of the strap being permanently affixed to said other side of the article of footwear, said strap extending from said other side of the article of footwear across said instep portion and through said first strap receiving guide, said strap extending from said first strap receiving guide through said buckle, across said instep portion a second time, and through said second strap receiving guide, said strap returning from said second strap receiving guide to said buckle for attachment thereto.

19. A fastening system for adjustably fitting a user's foot within an article of footwear, said fastening system comprising:

a strap including first and second opposite ends, said strap having an effective length whereby a shorter effective length will result in a tighter fit than a longer effective length and a longer effective length will result in a looser fit than a shorter effective length;

a strap receiving guide for receiving and guiding said strap along a path across a portion of the article of footwear; and a buckle for loosening and tightening the fit of the article of footwear, said buckle having a locking member movable between a first unlocked position whereby said buckle is movable along said strap to loosen or tighten the fit of the article of footwear by increasing or decreasing, respectively, the effective length of said strap, and a second locked position whereby said strap is clamped by said buckle to keep the effective length of the strap constant and prevent movement of said buckle with respect to said strap in both directions which can affect the effective length of the strap;

said strap being routed through said buckle such that said buckle is attached to the strap and no other pan of the article of footwear.

20. The fastening system as claimed in claim 19, wherein said first end of said strap being affixed to the article of footwear and said second end of said strap being attached to said buckle.

21. The fastening system as claimed in claim 19, said buckle further having a body including two side members and first and second cross-members for joining together said side members and a sliding bar slidably mounted with respect to said side members of the body for axial movement therealong, said movable locking member being pivotally mounted to said side members of said body for pivotal movement about a pivot axis spaced from said first cross member, wherein the strap is clamped against said sliding bar when said pivotal locking member is in said second locked position, said strap passing through an aperture located between said second cross-member, said pivotal locking member, and said side members.

22. The fastening system as claimed in claim 21, wherein said sliding bar includes a top surface, a first side surface facing said first cross-member, and a second side surface facing in a direction opposite of said first side surface, and said buckle further having a first complementary surface for substantially complementarily mating with one of said sliding bar surfaces and a second complementary surface for substantially complementarily mating with another of said sliding bar surfaces, and wherein the strap is clamped between said first complementarily mating surface and said one of the sliding bar surfaces, and between said second complementarily mating surface and said another of the sliding bar surfaces, when said pivotal locking member is in said second locked position.

23. The fastening system as claimed in claim 19, further comprising two strap receiving guides, wherein each said strap receiving guide is an eye bracket, and said buckle being movable along said strap between the two eye brackets.

24. The fastening system as claimed in claim 23, wherein said locking member is pivotally movable between said first unlocked and second locked positions.

25. The fastening system as claimed in claim 24, further comprising a gripping portion on said pivotal locking member, and wherein said gripping portion provides a surface which can be grasped to move the buckle along the strap or to pivotally move the locking member between its first and second positions.

26. The fastening system as claimed in claim 25, wherein said buckle further having a body including two side members and a first cross-member for joining together said side members, a sliding bar slidably mounted with respect to said side members of the body for axial movement therealong, wherein the strap is clamped against said sliding bar when said pivotal locking member is in said second locked position, said pivotal locking member including a pushing member which displaces said sliding bar towards said first cross-member to clamp the strap between said sliding bar and said first cross-member, said pivotal locking member being pivotally mounted to said side members of said body for pivotal movement about a pivot axis spaced from said first cross member.

27. The fastening system as claimed in claim 26, further comprising a slot in each said side member between said first cross-member and said pivot axis, said sliding bar including sliding members at opposite ends of said sliding bar, and wherein said sliding members of said sliding bar slide within said slots.

28. The fastening system as claimed in claim 23, wherein said article of footwear includes a lateral side, a medial side, and an instep portion, said fastening system further comprising a first strap receiving guide on one of said lateral and medial sides of the article of footwear and a second strap receiving guide on the other of said lateral and medial sides of the article of footwear, said first end of the strap being permanently affixed to said other side of the article of footwear, said strap extending from said other side of the article of footwear across said instep portion and through said first strap receiving guide, said strap extending from said first strap receiving guide through said buckle, across said instep portion a second time, and through said second strap receiving guide, said strap returning from said second strap receiving guide to said buckle for attachment thereto.

* * * * *